United States Patent [19]

Schollmeier et al.

[11] 4,059,460

[45] Nov. 22, 1977

[54] SOLID ANHYDROUS DEXTROSE

[75] Inventors: Charles E. Schollmeier; Roger S. Leiser, both of Decatur, Ill.

[73] Assignee: A. E. Staley Manufacturing Company, Decatur, Ill.

[21] Appl. No.: 629,739

[22] Filed: Nov. 7, 1975

[51] Int. Cl.[2] ..... C13K 1/10; C13K 1/06

[52] U.S. Cl. ..... 127/29; 127/30; 127/58; 127/61

[58] Field of Search ..... 127/30, 58, 60, 61, 127/29

[56] References Cited

U.S. PATENT DOCUMENTS

| | | | |
|---|---|---|---|
| 1,521,830 | 1/1925 | Newkirk | 127/58 |
| 1,571,212 | 2/1926 | Newkirk | 127/58 |
| 1,750,938 | 3/1930 | Newkirk | 127/58 |
| 1,783,626 | 12/1930 | Newkirk | 127/58 |
| 1,976,361 | 10/1934 | Newkirk | 127/58 |
| 2,029,560 | 2/1936 | Copland | 127/58 |
| 2,152,874 | 4/1939 | Copland | 127/58 |
| 2,192,951 | 3/1940 | Wolff | 127/29 |
| 2,429,964 | 10/1947 | Schopmeyer | 127/29 X |
| 2,433,818 | 12/1947 | Schopmeyer | 127/29 X |
| 2,439,384 | 4/1948 | Fetzer | 127/29 X |
| 2,502,935 | 4/1950 | Fetzer | 127/29 X |
| 2,669,530 | 2/1954 | Kite | 127/58 X |
| 3,239,378 | 3/1966 | Opila | 127/30 X |
| 3,257,665 | 6/1966 | Idaszak | 127/58 |
| 3,265,533 | 8/1966 | Meisel | 127/60 X |
| 3,406,046 | 8/1968 | Tittelboom | 127/30 X |
| 3,477,874 | 11/1969 | Repsdorph | 127/58 |
| 3,547,696 | 12/1970 | Mueller | 127/58 |
| 3,650,829 | 3/1972 | Walon | 127/30 X |
| 3,709,731 | 1/1973 | Kingma | 127/58 |
| 3,743,539 | 7/1973 | Kroyer | 127/58 X |
| 3,748,175 | 7/1973 | Kawamura | 127/60 |

*Primary Examiner*—Sidney Marantz
*Attorney, Agent, or Firm*—M. Paul Hendrickson; Charles J. Meyerson

[57] ABSTRACT

Non-compacting, anhydrous dextrose conversion syrup product in particle form prepared by shearing and cooling a molten dextrose conversion syrup (preferably at 90–92% dry solids) to a temperature less than 200° F., depositing and solidifying the fluid mass upon a supporting member to an anhydrous dextrose product, granulating the solidified product and drying the particles to less than 2% moisture. The anhydrous dextrose particles have unique properties and, if desired, may be used as a sugar or dextrose monohydrate replacement.

12 Claims, No Drawings

SOLID ANHYDROUS DEXTROSE

BACKGROUND OF THE INVENTION

Solid dextrose is conventionally manufactured by crystallizing supersaturated, high dextrose syrups and recovering the crystals therefrom in α-D-dextrose monohydrate crystal form (e.g., see U.S. Pat. No. 3,039,935). Yields depend upon carefully controlled cooling temperatures and dextrose supersaturation conditions. Complete recovery of the solids from the dextrose syrup cannot be accomplished because effective dextrose crystallization and separation therefrom requires supersaturated dextrose solutions. Accordingly, a significant portion of the dextrose will remain in the mother liquor or syrup upon completion of the dextrose crystallization step. Anhydrous α-dextrose is generally manufactured by dissolving α-D-dextrose monohydrate crystals in water and crystallizing at temperatures of 60°-65° C. in vacuum pans under carefully controlled processing conditions.

Solidification of all the conversion syrup solids without separating the dextrose therefrom has been proposed. U.S. Pat. No. 3,197,338, by T. L. Hurst, discloses a process for producing a crystalline, non-caking, dextrose product. In Hurst et al., a refined dextrose conversion syrup is concentrated to at least 95% solids (preferably greater than 98% solids), crystallized by kneading (e.g., at 170° F.-230° F.) and extruded in the form of ribbon or strand into a zone which rapidly cools the product to less than 150° F. The extrudate is then granulated to appropriate particle size. In U.S. Pat. No. 3,236,687, dextrose conversion syrup solids are reportedly converted into a solid form by subjecting a syrup concentrate (e.g., at a 93-96% solids level and 180°-220° F.) to high shear in the presence of gas to form minute glucose crystals. The nucleated, creamy, frothy dextrose mass is deposited upon a moving belt and solidified in a series of cooling zones maintained at progressively lower temperatures (e.g., first zone at 180°-220° F., second zone at 140°-180° F. and third zone less than 100° F.). The solidified mass is chipped, conditioned for 2-3 hours at 120°-180° F., ground and redried. Japanese Patent Specification Nos. 26250/61 and 23995/63 also disclose processes which rely upon aeration to convert dextrose conversion syrups to crystalline dextrose. Although numerous processes for directly converting dextrose conversion syrups into solids have been proposed, the dextrose monohydrate crystallization and separation process remains essentially the exclusive source of dextrose solids in this country.

Applicants sought a more effective, alternative method to produce a solid dextrose product on a commercial scale. They desired to produce a product having many of the desired attributes of crystalline dextrose monohydrate (e.g., free-flowing, non-compacting, stability against physical and chemical degradation such as typically encountered in the shipment and the trade usages thereof, adequate solubility and dispersibility in aqueous systems, appropriate whiteness and sweetness without off-flavors, etc.). A solid dextrose possessing uniquely different properties and usefulness was sought. A solid dextrose product which could be used in many applications as replacement for sucrose and/or dextrose monohydrate was also desired.

OBJECTS

It is an object of this invention to provide a novel process for recovering anhydrous dextrose products from dextrose conversion syrups.

Another object of the invention is to provide a novel free-flowing, non-compacting, anhydrous dextrose product which is essentially free from adverse flavors and color contaminants.

A further object is to directly recover anhydrous dextrose solids from a conversion syrup without separating crystalline dextrose from a mother liquor.

A still further object is to provide an effective and economical manufacture for converting starch hydrolyzate into a solid, anhydrous dextrose product.

DESCRIPTION OF THE INVENTION

According to the present invention, there is provided a process for preparing a solid, essentially free-flowing and non-compacting anhydrous dextrose product from a dextrose conversion syrup having a dextrose content of at least 93% (dry substanfce weight basis), said process comprising the steps of:

A. preparing a molten dextrose syrup concentrate characterized as having a dry weight solids content between 85% to 93% and a temperature in excess of 230° F., B. simultaneously shearing and gradationally cooling the concentrate to a temperature below 200° F. to form a more viscous but fluid dextrose mass, C. depositing the fluid dextrose mass in a confining zone while maintaining the fluid mass at a solids level below 93% and the temperature above the dextrose hydrate crystallization temperature, D. solidifying the fluid mass into a solid dextrose mass within the confining zone, E. granulating the solid dextrose mass into a multiplicity of dextrose particles, and F. dehydrating the dextrose particles to a water content of less than 2% by weight to provide a particulated, essentially free-flowing and non-compacting, anhydrous dextrose product.

Pursuant to the present invention, high-dextrose, conversion syrups are converted to a solid, anhydrous dextrose product. Conversion syrups containing at least 93% dextrose (total dry solids weight basis), especially those having at least 95% dextrose, are used as starting raw material. High dextrose conversion syrups containing about 96 to 99% by weight dextrose (d.s.b.) and only a nominal amount of non-dextrose solids may be obtained by saccharifying a thinned starch hydrolyzate (e.g., see U.S. Pat. No. 3,783,100) with glucoamylase and amylo-1,6-glucosidase (e.g., see U.S. Pat. No. 3,897,305 by T. L. Hurst).

It is desirable to utilize a refined dextrose conversion syrup as a starting material. Processing and solid dextrose product improvments are achieved by initially removing ash, proteinaceous, color and other undesirable flavor contaminants from the dextrose syrup. Insoluble organic and inorganic contaminants may be removed from the feed syrup by conventional refining techniques (e.g., filtration, centrifugration, etc.). Undesirable syrup flavor and color contaminants such as hydroxymethyl furfural (HMF) are removable by carbon treatment (e.g., 1-50 parts by weight carbon for each 500 parts syrup solids and preferably at about 5-10 pbw carbon). Ash and protein contaminants may be conveniently removed by anion and cation exchange resin treatment.

Under the processing conditions employed in this invention, an excessively high or low syrup pH can result in undesirable color and/or flavor contamination. Color and flavor contamination is generally avoided by using a dextrose feed syrup which has a pH between 3.0 and 5.0 and preferably within the pH range 3.3–4.2 range.

In step A of the process, a molten dextrose syrup concentrate having a solids content between 85–93% and a temperature in excess of 230° F. is prepared. Any means for concentrating the syrup to this solids level and temperature without adversely affecting its processability and the desired end-product may be used. Evaporation of the water from the feed syrup with high velocity, turbulent heat exchangers operated at short hold times and high heat transfer conditions (preferably in the substantial absence of molecular oxygen) such as steam plate heat exchanger equipped with steam trap and atmosphere syrup collectors are particularly effective. Heat exchangers which can effectively remove water at operative temperatures between about 235°–325° F. within a short residence time (e.g., between about 1 to about 3 seconds) minimize syrup degradation (e.g., chemical degradation such as oxidation, caramelization, etc.).

Subsequent processing difficulties (e.g., solidifying, grinding and drying to less than 1% moisture) can arise when the molten syrup dry solids level drops below 88% weight percent level (total syrup weight basis). Above the 93% dry solids level, premature solidification, adverse flavor and color formation, non-uniformity in drying, excessive viscosities and end-product efficacy are encountered. In a more limited embodiment of this invention, the syrup is concentrated to syrup solids level greater than 89% and preferably above 91% dry solids while maintaining the syrup (prior to solidification) at a temperature above the dextrose monohydrate crystallization temperature. Steam plate evaporators or heat exchangers operated at an evaporative temperature between about 250° F. to about 280° F. with a residence time of less than 10 seconds (preferably less than 5 seconds) are particularly effective in preparing the molten syrup concentrate and achieving a high quality solid dextrose product herein.

The molten syrup concentrate of Step A is subjected to a simultaneous shearing and gradationally cooling to a temperature below 200° F. (i.e., Step B). The molten dextrose syrup concentrate contains sufficient water to cause dextrose monohydrate crystallization. Accordingly, the cooling temperature is necessarily maintained above the syrup's dextrose monohydrate crystallization temperature. As recognized by the art, the dextrose monohydrte crystallization temperature will depend upon the syrup's dextrose solids level and its temperature (e.g., see Critical Data Tables, Third Edition, 1969 published by Corn Refiners Association, Inc., Washington, D.C. and National Bureau of Standards Circular 440, 1942, etc.).

The shearing and cooling step increases the syrup's viscosity while retaining sufficient fluidity to be deposited and shaped within the confining zone. Either high speed mixing devices (e.g., Cowles mixer operated at a high speed or scraped surface heat exchanger operated at a tip speed of 250–575 ft./min.) or low speed mixing devices equipped with cooling means (liquid extruders) may be effectively used to simultaneously shear and cool the molten syrup product. Excessive and prolonged shearing of the molten syrup concentrate at elevated temperatures (e.g., more than an hour at 190° F.) can physically and chemically degrade the dextrose. This will adversely affect both its processability and end product character. In order to minimize the deleterious effect of thermal degradation, the shearing and gradational cooling step is most suitably completed within a time interval of less than about 5 minutes to provide fluid dextrose mass having a temperature between about 150° F. to about 195° F. Illustrative simultaneous shearing (under high shear) and cooling temperatures (at ± 5° F.) are about 150° F. at 90% (dry solids weight basis) about 165° F. at 91% and about 190° F. at 92% within a preferred time interval of about 1 to about 2 minutes (e.g., via scrapped heat exchanger). These operating conditions are particularly effective in preparing a fluid mass which can thereafter be converted into a high quality solid, essentially non-compacting, free-flowing anhydrous dextrose particulated end-product. The simultaneous shearing and gradationally cooling (i.e., Step B) transiently preconditions the dextrose solids into a form highly susceptible to anhydrous dextrose solidification. It would appear as though the syrup solids level in combination with the simultaneous shearing and cooling thereof converts the fluid mass into an opaque mass which contains minute solids or microcrystalline solids uniformly dispersed within a fluid aqueous external phase comprised of syrup solute and water.

The sheared and cooled dextrose mass from Step B is then deposited in a confining zone at temperatures above its dextrose hydrate crystallization temperature (Step C). The sheared and cooled mass has sufficient fluidity so that it may be conventionally transferred and then shaped into a form most suitable for subsequent processing. The deposited fluid mass (e.g., at a 1/16 inch thickness) typically loses its flow character within about 2 minutes or less and most usually between about ½ to about 1½ minutes. Conventional means for mechanically shaping the fluid mass into desired form such as compartmentalized containers or trays of a size and configuration to permit uniform leveling thereof, depositing the fluid mass upon a conveyor in the form of continuous ribbons, strands or films, etc. may be used. Due to its viscosity and ease with which the Step B mass crystallizes, it is difficult to shape or level the deposited mass with direct contact mechanical spreading devices such as blades, spreaders, rollers, etc.

A particularly suitable means for shaping and forming the deposited fluid mass is pneumatically, such as with an airknife (e.g., see Pulp and Paper Manufacture, Vol. 2, Control Secondary Fiber Structural Board Coating, McGraw-Hill Book Company, © 1969, pages 503–504). Shaping of the fluid mass by pneumatic means afford several advantages: (a) uniformity in spreading and leveling of the fluid mass, (b) better processing control over the uniformity, homogenity, and character of the solidified dextrose product, (c) improvement in the grinding and drying characteristics of the solidified dextrose product and (d) means for simply, efficiently and quickly depositing the fluid mass on a commercial plant operation basis, etc. In a continuous operation, continuous belt conveyors may be used to continuously deposit, support, transport and solidify the fluid mass in combination with the pneumatic leveling devices for purposes of evenly spreading the fluid mass upon the moving belt in a suitable solidifiable form. An airknife, an endless belt to which the solidified dextrose product is non-adherent (e.g. polytetrafluoroethylene coated conveyor) and means for the continuously depositing of the fluid mass upon a moving belt at a uniform rate affords continuous production of solidified dextrose sheets.

The thickness of the deposited mass affects is processability and end-product character. An excessively thick mass can create difficulties in achieving the appropriate particle size and dryness. Excessively thick depositions (e.g., greater than ¾ inch thickness) can also lead to complications in obtaining a homogeneous and uniformly solidified dextrose mass within a reasonable residence time (e.g., wet spots; formation of plastic, non-brittle product which balls or forms a gummy material upon crushing or grinding instead of fracturing evenly; subsequent difficulties in drying the particulated product to a low moisture level, etc.). If the deposited mass is spread too thin, production capacity can be substantially curtailed. These difficulties are easily avoided by uniformly spreading the fluid mass upon the belt or other support member in the form of a continuous layer of about 1/32 to about ½ inch thick and preferably at a thickness of about 1/16 to about ¼ inch.

Appropriate regulation of the temperature prior and during its solidification within the confining zone should be observed (e.g., via temperature at which the mass is deposited). When deposited at an appropriate thickness and temperature the fluid mass can be easily solidified without necessitating ancillary heating equipment to control its temperature. At a thickness of about 1/16 to ¼ inch the liquid mass can be effectively solidified upon an open moving belt (e.g., belt passing through a surrounding ambient atmosphere at 20° C.) with the temperature of the deposited molten mass being sufficiently high enough to maintain it above its dextrose hydrate crystallization temperature. Appropriate solidification of the spread mass within the confining zone under the aformentioned conditions will generally occur within less than about 5 minutes and most typically between about 2 to about 4 minutes. Under these solidification conditions, the moisture content between the deposited fluid mass and that of the solidified product will remain substantially unchanged. Longer residence times within the confining zone can be used but are not required.

Upon completion of solidification Step D, the solidified dextrose mass is generally characterized as a white, self-supporting, hard, solid dextrose mass. The water content of the solidified (total dry solids weight) is generally within the range of about 88% to about 93% and preferably at about 91% ± 1%. Its dextrose content will depend upon the feed syrup dextrose content and preferably exceeds 95% of its total dry solids weight (i.e., excluding its water content).

The solidified dextrose mass is then granulated into a multiplicity of dextrose particles (Step E) and the particles are ultimately dehydrated to a water content of less than 2% (total product weight) to provide a particulated, essentially free-flowing, non-compacting, anhydrous dextrose product (Step F). Unlike conventional sugars, the solidified dextrose product obtained from Step C cannot be directly granulated to a uniform and fine particle size (e.g., uniform particles within the 40–850 micron size). Uniform, fine particle granulation is hindered by balling and doughing and the tendency of the mass to fracture non-uniformly. Apparently the high water content of the solidified mass functions as an internal plasticizer and lubricant which inhibits uniform fracturing of the particles to a uniform and small particle size. Aging (e.g., one day or more at 55% relative humidity or less) and/or cooling (e.g., below 100° F.), improves upon the granulating characteristics of the mass. Aging has a more pronounced effect upon granulated than does cooling. Aging is a limiting production factor when it is desired to continuously manufacture the anhydrous dextrose product.

The inability to granulate the solidified mass into a uniform and small particle size can be effectively overcome by crushing the solified mass into relatively large, irregular shaped pieces or chips (e.g., less than ¾ inch size), partially drying the chips (e.g., to less than about 5% moisture) and then granulating the chips to the smaller particles until the desired size is achieved. Crushing fractures the solid mass unevenly and non-uniformly, in a manner analogous to the breaking of glass, producing both coarse and fine sized particles. Fines produced (e.g., usually less than 5% fines) by crushing may be directly converted into a finished product by drying (i.e. Step F). Low shear crushers (e.g., low R.P.M. finger crusher) which break the solidified mass primarily (major portion on a weight basis) into crushed particles of about ¼ to about ½ inch size with less than about 5% by weight particles being of a 20 mesh or smaller size are effective in providing a coarse product which can be partially dried and then granulated to a fine particle size.

The crushed particles should be partially dried before granulating into a multiplicity of fine particles or smaller granules to avoid balling or doughing. The drying need not reduce the moisture content to less than 2%, but should be sufficient to overcome the dextrose masses tendency to ball or dough in the grinder. If more than one granulated step (incremental particle size reduction) is employed, drying of the final, granulated product is essential in order to achieve a non-compacting product.

Both the coarsely and finely ground dextrose product are dried. It is therefore, advantageous to allow both the coarse and fine particles to pass through the dryer together, screen and recover the dried fines and recycle the partially dried coarse grinds to the fine grinder. Typically, the fine grinding will produce about 1:2 weight ratio of fines to coarse particles. Accordingly a plurality of passes through the fine grinder (e.g., two or more) and dryer are normally required to convert substantially all of the solid dextrose into the desired fine particle size. Non-compacting, anhydrous dextrose fines having particle sizes within the range of between about 50 to about 5,000 microns (usually between about 100 to about 3,000 microns) can be effectively produced by incrementally reducing the particles to a smaller particle size until the desired particle size is achieved with a partial drying step being conducted after each granulation thereof. A product with a substantial uniform particle size distribution (e.g., below 850 microns) is obtained by screening. The over-sized particles are recycled for further size reduction and dried. Preferably the desired dried end-product particles are dried to less than 1% moisture (e.g., 0.5%–1% moisture range).

The undried particles will generally have a compaction rating in excess of 7, whereas the dried particles rating will typically be less than 5.0 and preferably less than 2.0. A product having a high compaction rating is generally unsuitable for reasons the particles will aggregate and form lumps when stored under pressure such as normally encountered in warehousing and the commercial shipment thereof.

The tableting characteristics of the dried, anhydrous dextrose product differs from either partially dried product (e.g., about 5% moisture) or crystalline dextrose monohydrate of an equivalent particle size. For example, tablets made from the dried, anhydrous dextrose product (e.g., 150–1,500 micron size) have a tablet hardness of less than 15 (e.g., usually between about 8 to about 12 kilograms). Comparative to the dried anhydrous dextrose particles, the hardness of partially dried product (e.g., 4–5% moisture) of an equivalent particle size, will usually be more than about two times harder (e.g., greater than 20 kilograms) than those which have been dried to less than 1% moisture. The dried anhydrous tablet can normally be orally masticated while the partially dried tableted products are too hard to be chewn. The tableted, dried, anhydrous dextrose particles, however, are generally at least 2 to about 3 times harder than those obtained from equivalent particle sized crystalline dextrose monohydrate.

At 55% relative humidity or less (e.g., 75° F.) the dried anhydrous dextrose products are non-hygroscopic.

The dried anhydrous dextrose products (e.g., particle size of 150 to 1,500 micron) obtained from Step F dissolve much more readily in water than equivalent-sized, dextrose particles of either crystalline dextrose monohydrate or the partially dried product. Comparative to equivalent-sized crystalline dextrose monohydrate particles, the dried anhydrous dextrose product of this invention will usually require 50% or less time to dissolve (e.g., <5 minutes vs. > 8 minutes). As further illustrated in the Example, the dried product (i.e., Step F product) typically has solution rates ranging from about 3 to 5 times greater than those commercial crystalline dextrose monohydrates and about 2–3 times faster than the partially dried anhydrous dextrose particles.

The dried products usually contain between about 15–60% beta dextrose and 40–85% alpha dextrose with most products having a beta dextrose to alpha dextrose weight ratio ranging from 1:2 to 1:1. The beta dextrose undoubtedly contributes to the rapid solution rates of the anhydrous dextrose which can be an important utility factor.

In general, the free-flowing non-compacting products contain crystalline anhydrous dextrose as a major dry solid and aminor amount of amorphous dextrose. The crystalline dextrose content of the product will usually be between about 60 to about 90% with 70–80% crystallinity being most typical.

The solid dextrose products are sweet without caramel flavor or other off-flavors.

The following examples are merely illustrative and should not be construed as limiting the scope of the invention.

EXAMPLE I

Corn syrup containing 64.8% dry substance and 97.1% dextrose (dry substance basis) was concentrated to 92–92.5% dry substrate in a plate evaporator operating at a discharge temperature of 270°–275° F. The evaporated water was separated from the concentrated syrup in a separator at atmospheric pressure. With a gear pump, the hot concentrated syrup was pumped immediately and continuously through a scraped heat exchanger. The 3-inch diameter scraped heat exchanger was operated at 450 R.P.M. with a discharge temperature of 175°–185° F. obtained by regulating the cooling water rate through the scraped heat exchanger jacket. With a processing rate of 55–60 pounds per hour (dry substance basis) the retention time in the scraped heat exchanger was about 1.9 minutes.

The opaque, partially crystallized fluid leaving the scraped heat exchanger was discharged onto an endless conveyor belt coated with polytetrafluoroethylene. With an air knife, the fluid mass was spread to a width of about 8 inches and about 1/16 inch thick. After about 2½ minutes on the belt the material was discharged from the belt in the form of hard and brittle slabs. A finger crusher operating at 120 R.P.M. at the end of the belt broke the slabs into chips about ¼ to ½ inch in size.

The coarse chips were conveyed to a rotary hot air dryer operating with 190°–194° F. inlet air temperature and of a size to give four hours retention time. The coarse partially dried chips leaving the dryer were conveyed to a hammer mill for fine grinding and then conveyed to the inlet of the dryer along with fresh feed (coarse chips). The material leaving the dryer is a mixture of partially dried coarse material and dry finely ground material. The dry finely ground material was removed as product by screening through 20 mesh screen. The overs were recycled to the grinder and dryer for completion of size reduction and drying. The ratio of recycled material to fresh feed or dried product was about 3 to 1.

A composite sample of 1,300 pounds of product had the following properties: 99.2% dry substance, 79% crystallinity, 56% alpha, 44% beta, compaction rating of 1.2, 8 ppm foreign matter, and good flavor (no caramel or off-flavors). The dried particle size distribution (by weight) was about 10% less than 88 microns, 10% between 88–140 micron size, 14% between 150–250 micron size, 26% between 250–420 micron size, and 40% larger than 420 micron size.

For comparative purposes, partially dried anhydrous dextrose particles having an equivalent particle size distribution were obtained by screening the coarsely ground product prior to complete drying. Commercial grades of crystalline dextrose monohydrate (STALEYDEX 444 and STALEYDEX 333, manufactured by A. E. Staley Manufacturing Company, Decatur, Ill.) produced in accordance with U.S. Pat. No. 3,039,935 were used for comparative test purposes.

Comparative differences between the compaction characteristics of the undried[1] and dried anhydrous dextrose test samples were determined via a Tinius Olsen Universal Tester employing a Carver cylindrical mold (1⅛ inch inner-diameter and 3 inches height) and matching mold die. Twenty-one gram test cylinders of the above samples were prepared by incrementally adding and compressing three 7 gram aliquots of each test sample to mold under the following compression conditions: (a) initial 7 grams compressed at 33 psi pressure for five (5) seconds, (b) another 7 gram aliquot, plus the initial compressed 7 gram sample compressed at 33 psi for 5 seconds, and (c) last 7 gram aliquot plus previously compressed (b) was compressed at 100 psi for 5 minutes. The compressed 21 gram cylindrical samples were then placed in an upright position (i.e., flat). The force required to fracture each compressed test sample cylinder was determined with the Tinius Olsen Universal Tester at a crosshead speed of 0.05 inch/minute and full scale setting (i.e., 60 pounds). The compaction ratings were calculated as follows:

Compaction rating = 60 pounds (% scale reading at fracture/100)

1 — obtained by aging the solidified dextrose mass for 24 hours at 23° C. and then fine grinding without further drying.

The compaction rating for the undried particles ranged from about 7 to 30 as opposed to a 0–1.5 for the dried particles.

Dried anhydrous dextrose particles, partially dried anhydrous dextrose particles and crystalline dextrose samples were tableted with a Coulton 204 press, four stations, employing ⅜ inch diameter cup punches and dies at 7500 psi maximum press pressure. Tablet hardness was determined with a Tablet Hardness Tester, Strong Cobb Arner, Inc., Model B. Hardness was calculated from maximum gauge reading by the following equation:

Maximum gauge reading × 0.78 = hardness in kilograms force

Solution rates (until completely dissolved) were determined via test samples which consisted of 150 grams water and 50 grams of dextrose sample stirred with a magnetic stirrer at speed 8 (Fischer Thermix) and 66° F.

Comparative data for the above tests are recorded in the Table.

TABLE

| TEST SAMPLE | PARTICLE SIZE (Microns) | WATER CONTENT (%) | TABLET-ABILITY | HARDNESS (kg-force) | MASTICATION CHARACTER | SOLUTION RATE (min.) |
|---|---|---|---|---|---|---|
| Dried anhydrous dextrose | | | | | | |
| 1. fines | <177 | 0.4% | couldn't tablet | — | — | 2–3 |
| 2. medium | 177–590 | 0.5% | gummy, stalled press | 9.4 | chewable | 3–4 |
| 3. course | 590–1680 | 0.5% | " | 11.5 | " | 3–4 |
| Partially dried dextrose | | | | | | |
| 4. fines | <177 | 6.8% | split easily | >20.3* | too hard | 6–8 |
| 5. medium | 177–590 | 5.5% | " | >20.3* | " | 9–10 |
| 6. course | 590–1680 | 5.7% | " | >20.3* | " | 11–12 |
| Crystalline dextrose monohydrate | | | | | | |
| 7. STALEYDEX 444 | 177–1190 | 8.8% | easy | 3.9 | chewable | 12–13 |
| 8. STALEYDEX 333 | <177 | 8.4% | — | | — | 9–10 |

*didn't break at maximum gauge reading

Since many embodiments of this invention may be made and since many changes may be made in the embodiments described, the foregoing is interpreted as illustrative and the invention is defined by the claims appended hereafter.

We claim:

1. A process for preparing a solid, essentially free-flowing and non-compacting anhydrous, dextrose conversion syrup product from a dextrose conversion syrup having a dextrose content of at least 93% (dry substance weight basis), said process comprising the steps of:

A. preparing a molten dextrose conversion syrup concentrate having a dry weight solids content between 85% and 93% and a temperature in excess of 230° F. from the dextrose conversion syrup, B. simultaneously shearing and cooling the concentrate to a temperature below 200° F. to form a more viscous but fluid dextrose conversion syrup mass, C. depositing the fluid mass in a confining zone while maintaining the fluid mass at a solids level below 93% and the temperature above the dextrose hydrate crystallization temperature, D. solidifying the fluid mass into a solid dextrose conversion syrup mass within the confining zone, E. granulating the solid dextrose conversion syrup mass into a multiplicity of particles, and F. dehydrating the dextrose conversion syrup particles to a water content of less than 2% by weight to provide a particulated, essentially free-flowing and non-compacting, anhydrous, dextrose conversion syrup product.

2. The process according to claim 1 wherein the dextrose content of the syrup (on a dry solids weight basis) is at least 95%.

3. The process according to claim 1 wherein the molten syrup concentrate has a dry solids content ranging from about 90% to about 92% and the syrup concentrate is simultaneously sheared and cooled to a temperature ranging from about 150° F. to about 190° F.

4. The process according to claim 3 wherein the simultaneously sheared and cooled fluid concentrate is continuously deposited and spread in the confining zone to a thickness ranging from about 1/32 inch to about ½ inch.

5. The process according to claim 4 wherein the solidified dextrose conversion syrup mass is granulated by initially crushing the solidified mass into coarse irregular shaped pieces, reducing the moisture content of the crushed pieces to a level sufficient to permit the pieces to be ground to a smaller particle size and granulating the crushed pieces to a particle size ranging from about 50 to about 5,000 microns.

6. The process according to claim 5 wherein substantially all the granulated dextrose particles have a particle size of less than about 1,700 microns.

7. The process according to claim 6 wherein the granulated, dextrose conversion syrup particles are dehydrated to a water content of less than 1%.

8. The process according to claim 1 wherein the solid dextrose conversion syrup mass is incrementally reduced to anhydrous, dextrose conversion syrup particles of a smaller particle size by a plurality of granulation steps.

9. The process according to claim 8 wherein the syrup concentrate contains between 88% to 93% by weight dry solids and the sheared and cooled mass is continuously solidified within the confining zone at a thickness of about 1/16 inch to about ¼ inch.

10. The process according to claim 9 wherein the dextrose content of syrup concentrate is at least 95% (d.s.b.), the simultaneously sheared and cooled concentrate contains at least 90% dry solids at a temperature greater than about 150° F. and the granulated dextrose particles are dehydrated to a water content of less than 1% by weight.

11. The granulated, free-flowing and non-compacting, anhydrous dextrose conversion syrup product prepared in accordance with the process of claim 1.

12. A granulated, free-flowing, non-compacting, anhydrous dextrose conversion syrup product prepared in accordance with claim 10, said conversion syrup product having a particle size of less than about 1,700 microns and containing between about 15% to 60% beta dextrose and 40% to 85% alpha dextrose.

* * * * *

UNITED STATES PATENT AND TRADEMARK OFFICE

CERTIFICATE OF CORRECTION

PATENT NO. : 4,059,460

DATED : November 22, 1977

INVENTOR(S) : Charles E. Schollmeier et al.

It is certified that error appears in the above-identified patent and that said Letters Patent are hereby corrected as shown below:

Column 2, line 22; for "substanfce" read ---substance---
Column 2, line 63; for "centrifugration" read ---centrifugation---
Column 3, line 36;for "to syrup" read ---to a syrup---
Column 4, line 41; for "into desired form such" read ---into the desired form, such---
Column 5, line 7; for "is" read ---its---
Column 6, bridging lines 6 and 7; for "grandulated" read ---granulation---
Column 6, line 12; for "solified" read ---solidified---
Column 6, line 36; for "granulated" read ---granulation---
Column 6, line 57; for "substantial" read ---substantially---
Column 7, line 47; for "free-flowing non-compacting" read ---free-flowing, non-compacting---
Column 7, line 49; for "aminor" read ---a minor---
Column 8, line 19; for "coarse partially" read ---coarse, partially---

Signed and Sealed this

*Eighth* Day of *May 1979*

[SEAL]

*Attest:*

RUTH C. MASON
*Attesting Officer*

DONALD W. BANNER
*Commissioner of Patents and Trademarks*